US006349941B1

(12) United States Patent
Cuss

(10) Patent No.: US 6,349,941 B1
(45) Date of Patent: Feb. 26, 2002

(54) STAMP COLLECTING BOARD GAME

(76) Inventor: Maurice A. Cuss, R.R. #1, Site 9, Box 7, Port Sydney, Ontario (CA), P0B 1L0

( * ) Notice: Subject to any disclaimer, the term of this patent is extended or adjusted under 35 U.S.C. 154(b) by 0 days.

(21) Appl. No.: 09/519,762

(22) Filed: Mar. 6, 2000

(51) Int. Cl.[7] ..... A63F 3/00
(52) U.S. Cl. ..... 273/243; 273/248
(58) Field of Search ..... 273/243, 248, 273/236, 249, 258

(56) References Cited

U.S. PATENT DOCUMENTS

| | | | |
|---|---|---|---|
| 2,479,747 | A | 8/1949 | Lachance |
| 4,629,195 | A | 12/1986 | Charney |
| 4,961,582 | A | 10/1990 | Van Lysel |
| 5,013,048 | A | 5/1991 | Turner |
| D377,055 | S | 12/1996 | Thompson |
| 5,679,000 | A | 10/1997 | Joyce |

*Primary Examiner*—Benjamin H. Layno
*Assistant Examiner*—V K Mendiratta

(57) ABSTRACT

A stamp collecting board game for teaching players about collecting stamps. The stamp collecting board game includes a game board. The game board has a top surface and a peripheral edge. A game path on the game board extends around the game board. A plurality of country indicia is on the game board. The country indicia are generally located in the game path. An ending path extends from the game path to a middle location of the board. A chance means determines movement about the game and ending paths. A plurality of stamps has indicia thereon indicating one of the country indicia. A plurality of game pieces is provided. The players each choose a game piece. The chance means is used to determine movement of the game piece about the game path and the ending path. Players collect a stamp when a player lands on the country indicia. A player wins the game by moving the game piece to an end space of the ending path.

9 Claims, 2 Drawing Sheets

STAMP COLLECTING BOARD GAME

BACKGROUND OF THE INVENTION

1. Field of the Invention

The present invention relates to board games and more particularly pertains to a new stamp collecting board game for teaching players about collecting stamps.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,579,000; U.S. Pat. No. 4,629,195; U.S. Pat. No. 4,961,582; U.S. Pat. No. 5,013,048; U.S. Pat. No. 2,479,747; and U.S. Des. Pat. No. 377,055.

While these devices fulfill their respective, particular objectives and requirements, the aforementioned patents do not disclose a new stamp collecting board game. The inventive device includes a game board. The game board has a top surface and a peripheral edge. A game path on the game board extends around the game board. A plurality of country indicia is on the game board. The country indicia are generally located in the game path. An ending path extends from the game path to a middle location of the board. A chance means determines movement about the game and ending paths. A plurality of stamps has indicia thereon indicating one of the country indicia. A plurality of game pieces is provided. The players each choose a game piece. The chance means is used to determine movement of the game piece about the game path and the ending path. Players collect a stamp when a player lands on the country indicia. A player wins the game by moving the game piece to an end space of the ending path.

In these respects, the stamp collecting board game according to the present invention substantially departs from the conventional concepts and designs of the prior art, and in so doing provides an apparatus primarily developed for the purpose of teaching players about collecting stamps.

SUMMARY OF THE INVENTION

In view of the foregoing disadvantages inherent in the known types of board games now present in the prior art, the present invention provides a new stamp collecting board game construction wherein the same can be utilized for teaching players about collecting stamps.

The general purpose of the present invention, which will be described subsequently in greater detail, is to provide a new stamp collecting board game apparatus and method which has many of the advantages of the board games mentioned heretofore and many novel features that result in a new stamp collecting board game which is not anticipated, rendered obvious, suggested, or even implied by any of the prior art board games, either alone or in any combination thereof.

To attain this, the present invention generally comprises a game board. The game board has a top surface and a peripheral edge. A game path on the game board extends around the game board. A plurality of country indicia is on the game board. The country indicia are generally located in the game path. An ending path extends from the game path to a middle location of the board. A chance means determines movement about the game and ending paths. A plurality of stamps has indicia thereon indicating one of the country indicia. A plurality of game pieces is provided. The players each choose a game piece. The chance means is used to determine movement of the game piece about the game path and the ending path. Players collect a stamp when a player lands on the country indicia. A player wins the game by moving the game piece to an end space of the ending path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stamp collecting board game apparatus and method which has many of the advantages of the board games mentioned heretofore and many novel features that result in a new stamp collecting board game which is not anticipated, rendered obvious, suggested, or even implied by any of the prior art board games, either alone or in any combination thereof.

It is another object of the present invention to provide a new stamp collecting board game which may be easily and efficiently manufactured and marketed.

It is a further object of the present invention to provide a new stamp collecting board game which is of a durable and reliable construction.

An even further object of the present invention is to provide a new stamp collecting board game which is susceptible of a low cost of manufacture with regard to both materials and labor, and which accordingly is then susceptible of low prices of sale to the consuming public, thereby making such stamp collecting board game economically available to the buying public.

Still yet another object of the present invention is to provide a new stamp collecting board game which provides in the apparatuses and methods of the prior art some of the advantages thereof, while simultaneously overcoming some of the disadvantages normally associated therewith.

Still another object of the present invention is to provide a new stamp collecting board game for teaching players about collecting stamps.

Yet another object of the present invention is to provide a new stamp collecting board game which includes a game board. The game board has a top surface and a peripheral edge. A game path on the game board extends around the game board. A plurality of country indicia is on the game board. The country indicia are generally located in the game path. An ending path extends from the game path to a middle location of the board. A chance means determines movement about the game and ending paths. A plurality of stamps has indicia thereon indicating one of the country indicia. A plurality of game pieces is provided. The players each choose a game piece. The chance means is used to determine movement of the game piece about the game path and the ending path. Players collect a stamp when a player lands on the country indicia. A player wins the game by moving the game piece to an end space of the ending path.

Still yet another object of the present invention is to provide a new stamp collecting board game that teaches players about other cultures.

Even still another object of the present invention is to provide a new stamp collecting board game that provides a challenge to collect stamps and be the first player to win the game by getting to the ending space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
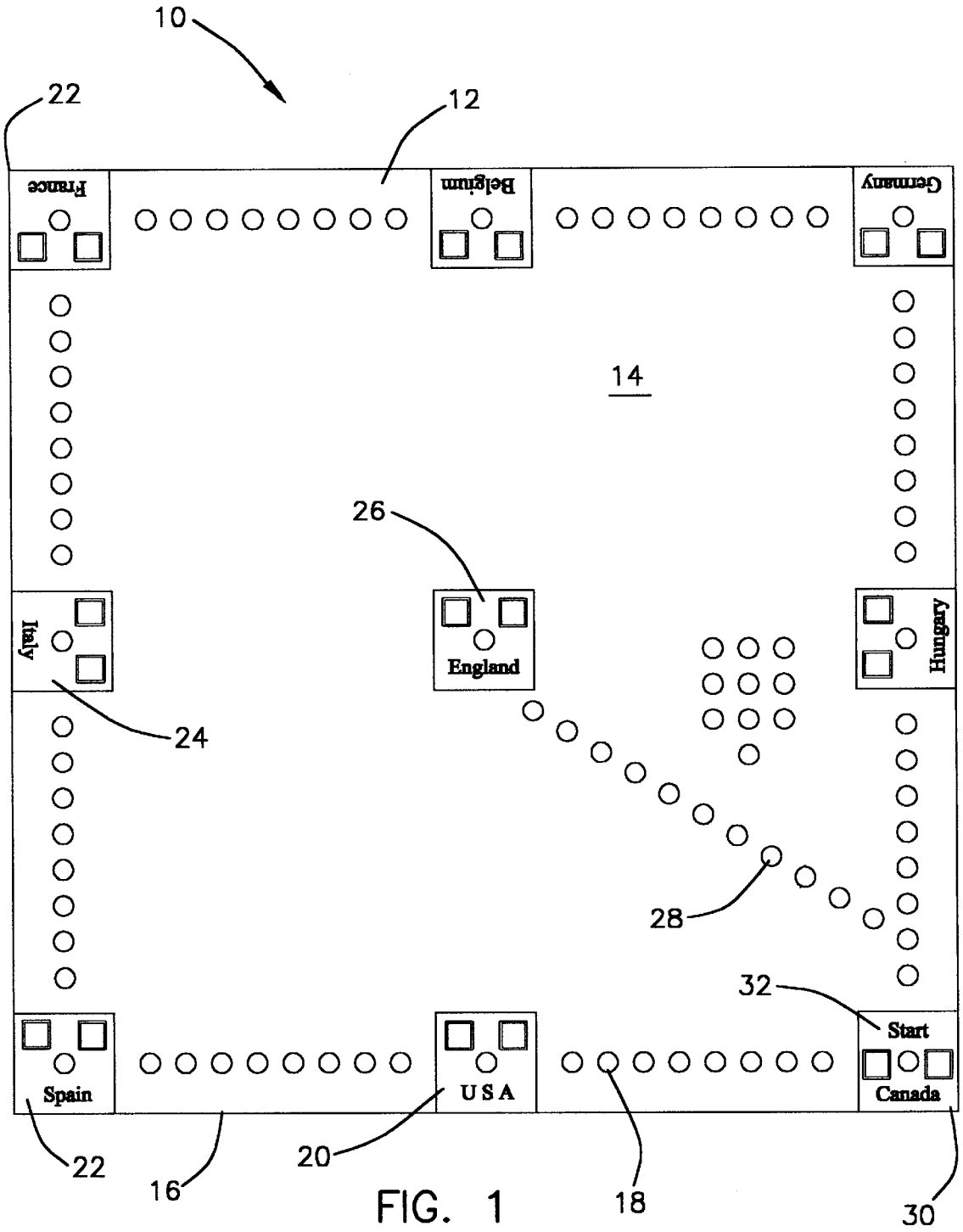
FIG. 1 is a schematic plan view of a new stamp collecting board game according to the present invention.
Figure 2:
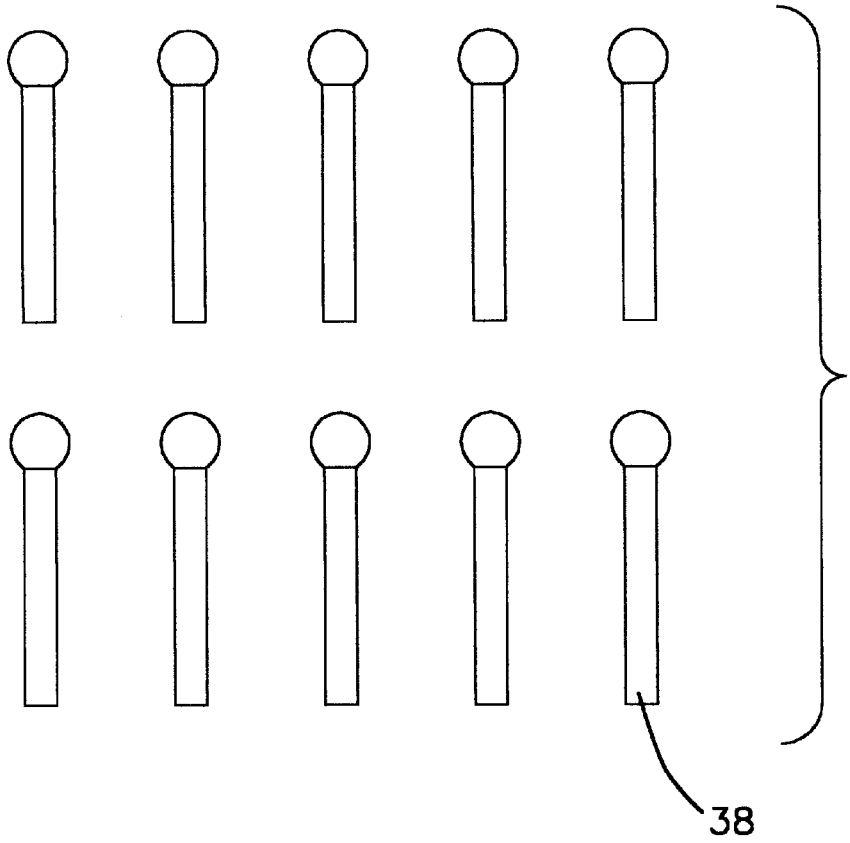
FIG. 2 is a schematic side view of the game pieces of the present invention.
Figure 3:
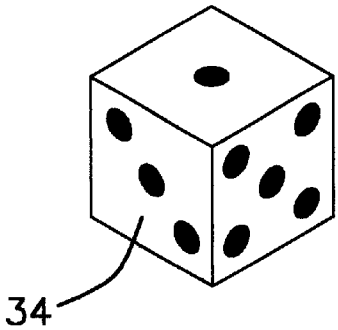
FIG. 3 is a schematic perspective view of the chance means of the present invention.
Figure 4:
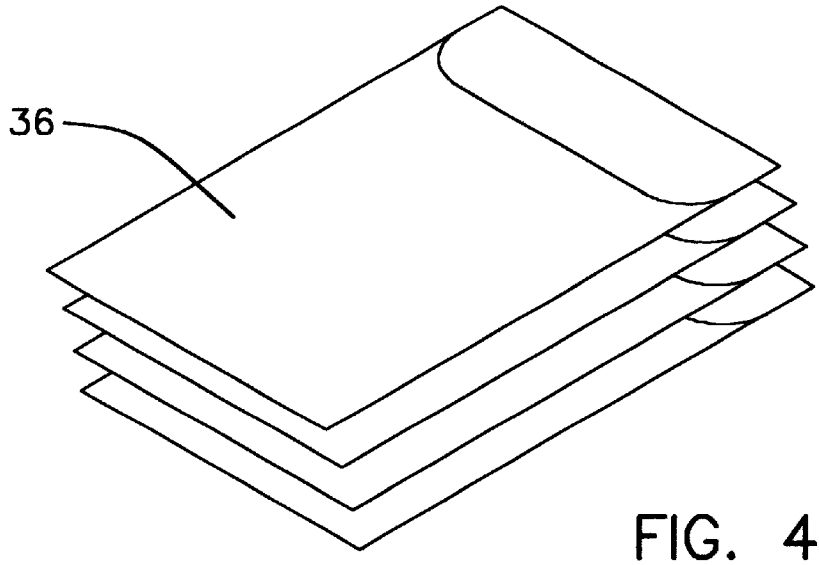
FIG. 4 is a schematic perspective view of the envelopes which contain the stamps of the present invention.

With reference now to the drawings, and in particular to FIGS. 1 through 4 thereof, a new stamp collecting board game embodying the principles and concepts of the present invention and generally designated by the reference numeral 10 will be described.

As best illustrated in FIGS. 1 through 4, the stamp collecting board game 10 generally comprises a game board 12. The game board has a top surface 14 and a peripheral edge 16. Preferably, the game board 12 has a generally rectangular shape.

A game path 18 on the game board 12 comprises a plurality of bores. The game path 18 extends around the game board 12 generally adjacent to the peripheral edge 16 of the game board.

A plurality of country indicia 20 is the game board. The country indicia 20 are generally located in the game path 18. Each of the country indicia 20 is generally located in a corner 22 of the game path 18 and in a middle location 24 between two of the corners 22. One of the country indicia 20 is in a middle location 26 of the game board. The country indicia 20 are preferably selected from the countries Canada, U.S.A., Spain, Italy, France, Belgium, Germany, Hungary and England, although any country may be used.

An ending path 28, comprising a plurality of bores, extends from the game path 18 to a middle location 26 of the board. The ending path 28 begins generally adjacent to a first corner 30 of the game board 12. Preferably, the first corner 30 of the game board 12 has the country indicia 20 therein indicating Canada, although the first corner may be represented by any country and one is selected here for ease of demonstration. In this example, the country indicia indicating Canada defines a starting position 32. The ending path 28 extends to the country indicia in the middle location 26 of the game board. In this example, the country indicia 20 in the middle location 26 of the game board indicate England.

A chance means 34 determines movement about the game and ending paths. Preferably, the chance means 34 is a six-sided die.

A plurality of stamps is utilized. Each of the stamps has indicia thereon indicating one of the country indicia. The stamps are kept in envelopes 36 for easy storage.

A plurality of game pieces 38 is provided. Each of the game pieces 38 has a different color. The game pieces 38 are pegs adapted to fit in the bores.

A plurality of cards having indicia thereon are placed in card spaces 50 on the game board. The cards instruct the player to move forward or backward on the game board. A card is drawn if the player lands in the space adjacent to the cards.

A plurality of storage bores 60 hold pegs when the game is not being played.

Rules of the Game

Up to two to ten players may play.

The players each choose a peg.

The players each roll the die to begin play. A dice roll of six is needed to begin play, wherein a six indicates placing player's peg in the starting position.

The players take turn in clock-wise order of rolling the die to determine movement of the peg about the game path and the ending path. The die is rolled again when the player rolls a six.

A stamp is collected when a player lands on the country indicia. The collected stamp has indicia thereon indicating the country indicia the player has landed on. Each of the players collects three of the stamps in the starting position.

When a player moves to bore space occupied by the peg of another player, the peg occupying the space is the bumped peg and the peg moving to the occupied space is the bumping peg.

The bumped peg is moved backwards one bore in the game path when the bumping peg lands on the bumped peg.

The bumped peg is moved to the starting position of the bumping peg when the bumped peg is located in a bore of the country indicia.

The game is won by moving the peg into the country indicia indicating England, or whatever country is at the end of the ending path. The peg must move a number of bores equal to the dice roll.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a stamp collecting game, comprising the steps of:

providing a game board, said game board having a top surface, said game board having a peripheral edge;

providing a game path on said game board, said game path extending around said game board, said game path comprising a plurality of bores;

providing a plurality of country indicia on said game board, said country indicia being generally located in said game path;

providing an ending path, said ending path extending from said game path to a middle location of said board;

providing a chance means for determining movement about said game and ending paths, said chance means being a six-sided die;

providing a plurality of stamps, each of said stamps having indicia thereon indicating one of said country indicia;

providing a plurality of game pieces;

providing a plurality of players;

choosing a game piece;

using the chance means to determine movement of said game piece about said game path and said ending path;

rolling said die to begin play, a dice roll of six being needed to begin play, wherein a player rolling a six indicates placing player's peg in said starting position;

rolling the die to determine movement of said peg about said game path and said ending path, rolling said die again when said player rolls a six;

moving to a bore space occupied by the peg of another player, wherein the peg occupying the space is the bumped peg and the peg moving to the occupied space is the bumping peg;

moving said bumped peg backwards one bore in said game path when said bumping peg lands on said bumped peg, moving said bumped peg to the starting position of said bumping peg when said bumped peg is located in a bore of said country indicia;

collecting a stamp when a player lands on said country indicia;

winning said game by moving said game piece to an end space of said ending path, wherein said peg must move a number of bores equal to the dice roll.

2. The method of playing a stamp collecting game as in claim 1, wherein the steps of providing a game board and game path comprise:

said game board having a generally rectangular shape; and said game path extending around said game board generally adjacent to said peripheral edge of said game board.

3. The method of playing a stamp collecting game as in claim 1, wherein the step of providing a plurality of said country indicia comprises:

each of said country indicia being generally located in a corner of said game path and in a middle location between two of said corners, one of said country indicia being in a middle location of said game board.

4. The method of playing a stamp collecting game as in claim 1, wherein the step of providing a plurality of said country indicia comprises:

said country indicia comprising the group containing Canada, U.S.A., Spain, Italy, France, Belgium, Germany, Hungary and England.

5. The method of playing a stamp collecting game as in claim 1, wherein the step of providing an ending path comprises:

said ending path comprising a plurality of bores, said ending path beginning generally adjacent to a first corner of said game board, said first corner of said game board having said country indicia therein indicating Canada, said country indicia indicating Canada defining a starting position, said ending path extending to said country indicia in said middle location of said game board, said country indicia in said middle location of said game board indicating England.

6. The method of playing a stamp collecting game as in claim 1, wherein the step of providing a plurality of game pieces comprises:

each of said game piece having a different color, said game pieces being pegs adapted to fit in said bores.

7. The method of playing a stamp collecting game as in claim 1, wherein the step of collecting a stamp comprises:

said collected stamp having indicia thereon indicating said country indicia the player has landed on, each of said players collecting three of said stamps in said starting position.

8. The method of playing a stamp collecting game as in claim 1, wherein the step of winning the game comprises:

winning said game by moving said peg into said country indicia indicating England.

9. A method of playing a stamp collecting game, comprising the steps of:

providing a game board, said game board having a top surface, said game board having a peripheral edge, said game board having a generally rectangular shape;

providing a game path on said game board, said game path comprising a plurality of bores, said game path extending around said game board generally adjacent to said peripheral edge of said game board;

providing a plurality of country indicia on said game board, said country indicia being generally located in said game path, each of said country indicia being generally located in a corner of said game path and in a middle location between two of said corners, one of said country indicia being in a middle location of said game board, said country indicia comprising the group containing Canada, U.S.A., Spain, Italy, France, Belgium, Germany, Hungary and England;

providing an ending path, said ending path comprising a plurality of bores, said ending path extending from said game path to a middle location of said board, said ending path beginning generally adjacent to a first corner of said game board, said first corner of said game board having said country indicia therein indicating Canada, said country indicia indicating Canada defining a starting position, said ending path extending to said country indicia in said middle location of said game board, said country indicia in said middle location of said game board indicating England;

providing a chance means for determining movement about said game and ending paths, said chance means being a six-sided die;

providing a plurality of stamps, each of said stamps having indicia thereon indicating one of said country indicia;

providing a plurality of game pieces, each of said game piece having a different color, said game pieces being pegs adapted to fit in said bores;

providing a plurality of players;

choosing a peg;

rolling said die to begin play, a dice roll of six being needed to begin play, wherein a player rolling a six indicates placing player's peg in said starting position;

rolling the die to determine movement of said peg about said game path and said ending path, rolling said die again when said player rolls a six;

collecting a stamp when a player lands on said country indicia, said collected stamp having indicia thereon indicating said country indicia the player has landed on, each of said players collecting three of said stamps in said starting position;

moving to bore space occupied by the peg of another player, wherein the peg occupying the space is the bumped peg and the peg moving to the occupied space is the bumping peg;

moving said bumped peg backwards one bore in said game path when said bumping peg lands on said bumped peg, moving said bumped peg to the starting position of said bumping peg when said bumped peg is located in a bore of said country indicia; and winning said game by moving said peg into said country indicia indicating England, wherein said peg must move a number of bores equal to the dice roll.

* * * * *